US006293255B1

(12) United States Patent
Otome et al.

(10) Patent No.: US 6,293,255 B1
(45) Date of Patent: Sep. 25, 2001

(54) FUEL INJECTION SYSTEM

(75) Inventors: Kimitake Otome; Junichi Kaku; Hidetoshi Kageyama, all of Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/569,390

(22) Filed: May 12, 2000

Related U.S. Application Data

(62) Division of application No. 09/016,921, filed on Feb. 2, 1998, now Pat. No. 6,146,102.

(30) Foreign Application Priority Data

Jan. 31, 1997 (JP) ..... 9-18551

(51) Int. Cl.[7] ..... F02M 37/04
(52) U.S. Cl. ..... 123/498; 417/45
(58) Field of Search ..... 123/498, 357, 123/447; 239/533.13, 533.12, 533.14; 417/322, 45

(56) References Cited

U.S. PATENT DOCUMENTS

| | | | | |
|---|---|---|---|---|
| 3,598,506 | | 8/1971 | O'Neill | 417/383 |
| 3,924,974 | | 12/1975 | Fischbeck et al. | 417/322 |
| 4,082,481 | * | 4/1978 | Fenne | 123/498 |
| 4,499,878 | | 2/1985 | Igashira et al. | 123/478 |
| 4,635,849 | | 1/1987 | Igashira et al. | 239/102.2 |
| 4,649,886 | * | 3/1987 | Igashira et al. | 123/498 |
| 4,748,954 | | 6/1988 | Igashira et al. | 123/494 |
| 4,821,726 | | 4/1989 | Tamura et al. | 123/498 |
| 4,899,714 | | 2/1990 | Schechter et al. | 123/533 |
| 4,939,405 | | 7/1990 | Okuyama et al. | 310/330 |
| 5,004,945 | * | 4/1991 | Tomita et al. | 123/498 |
| 5,020,724 | | 6/1991 | Kiyono et al. | 123/498 |
| 5,036,821 | | 8/1991 | Horiuchi et al. | 123/506 |
| 5,192,197 | | 3/1993 | Chip | 123/498 |
| 5,482,213 | | 1/1996 | Matsusaka et al. | 123/90.61 |

FOREIGN PATENT DOCUMENTS

| | | |
|---|---|---|
| 52-20407 | 2/1977 | (JP) . |
| 6-88572 | 3/1994 | (JP) . |
| 8-82266 | 3/1996 | (JP) . |

OTHER PUBLICATIONS

Electrostrictive Materials, http://www.luec.leeds.ac.uk/ElectrostrictiveMaterials.htm.*

* cited by examiner

*Primary Examiner*—Henry C. Yuen
*Assistant Examiner*—Mahmoud Gimie
(74) *Attorney, Agent, or Firm*—Ernest A. Beutler

(57) ABSTRACT

The present invention is an injection system including an injection device. The injection device includes a pumping chamber and an electrically operated device associated with the pumping chamber which, when energized, is capable of providing a rapid increase in localized fluid pressure in said pumping chamber without reciprocating a piston in a cylinder bore. A discharge port associated with the pumping chamber permits discharging of fluid displaced by the localized pressure increase. The injection system includes a circuit providing an energizing voltage to the electrically operated device, and a control for changing at least one characteristic of the energizing voltage selected from the group consisting of: the peak energizing voltage, the rate at which said energizing voltage increases, the rate at which said energizing voltage decreases, the duration of energization, and the frequency of energization.

4 Claims, 14 Drawing Sheets

FUEL INJECTION SYSTEM

CROSS REFERENCE TO RELATED APPLICATION

This application is a division of our application of the same Title, Ser. No. 09/016,921 now issued as U.S. Pat. No. 6,146,102; Filed, Feb. 2, 1998 and assigned to the assignee hereof.

FIELD OF THE INVENTION

This invention relates to a fuel injection system, and more particularly to an injection system, which provides improved injection volume and timing control.

BACKGROUND OF TE INVENTION

Recently a great deal of attention has been given to the level of emissions generated by internal combustion engines, as well as their efficiency. In order to increase the efficiency of these engines and reduce their harmful emissions, fuel injectors have been developed for metering the fuel supplied to the engine.

In general, these fuel injectors include a body having a solenoid operated flow valve. Biasing means such as a spring apply a force to a body of the valve for closing the valve, while when activated the solenoid overcomes the spring force to open the valve.

Fuel is supplied under high pressure to the fuel injector, such as with a high pressure pump. When the valve of the injector is opened, the fuel flows therethrough to the engine.

A problem associated with this valve is that the range of opening time of the valve of the injector cannot be controlled with infinite precision. In particular, the momentum of the mass of the valve body, spring and the like serve to limit the rate of speed with which the valve may be opened and reclose. A typical minimum working during may be about 1 Ms.

At this long minimum working duration, maximum fuel delivery benefits are generally only achieved when the engine speed is less than about 1000 rpm. When the engine speed is above this speed, as is very common with today's engines, the duration during which fuel is delivered to the engine during a given cycle is longer than the desired fuel injection duration.

One manner to decrease the working duration in this type of valve is to decrease the pressure at which the fuel is delivered. This permits the valve to close somewhat faster. On the other hand, this solution has the attenuated problem that the low fuel pressure may not permit atomization of the fuel, which is injected, reducing the burn efficiency and thus overall engine efficiency and emissions benefits.

It is an object of the present invention to provide a fuel injection system, which provides for a large dynamic range of injection time, permitting the fuel injection time to be varied over a wide time duration. It is a further object of the present invention to provide a fuel injection system, which permits accurate control of the volume of fuel delivered, and the time of delivery thereof.

SUMMARY OF THE INVENTION

The present invention is an injection system including an injection device. The injection device includes a pumping chamber and an electrically operated device associated with the pumping chamber which, when energized, is capable of providing a rapid increase in localized fluid pressure in said pumping chamber without reciprocating a piston in a cylinder bore. A discharge port associated with the pumping chamber permits discharging of fluid displaced by the localized pressure increase.

The injection system includes means for providing an energizing voltage to the electrically operated device, and control means for changing at least one characteristic of the energizing voltage selected from the group consisting of: the peak energizing voltage, the rate at which said energizing voltage increases, the rate at which said energizing voltage decreases, the duration of energization, and the frequency of energization.

In the preferred embodiment, the injection device is a fuel injection device for delivering fuel to an internal combustion engine. In this arrangement, control means is arranged to control the at least one characteristic of the energizing voltage dependent upon the magnitude or rate of change of the engine load.

In accordance with the present mvention, an injection device is provided which permits accurate control of the volume and time of liquid injected.

BRIEF DESCRIPTION OF THE DRAWINGS

FIG. 6(*b*) is a graph illustrating the characteristic of fuel pressure vs. time for the fuel injection device of the invention;

DETAILED DESCRITION O FTH PREFERRED EMBODIMENT

In general, the present invention is an injection system for controlling the injection of a liquid such as fuel. The invention is described for use with an internal combustion engine since this is an application for which the injection system has particular utility.

Those of skill in the art will appreciate that the injection system has utility in a variety of other applications and for use in injecting a variety of other liquids, such as oil, ink or the like.

Figure 1:
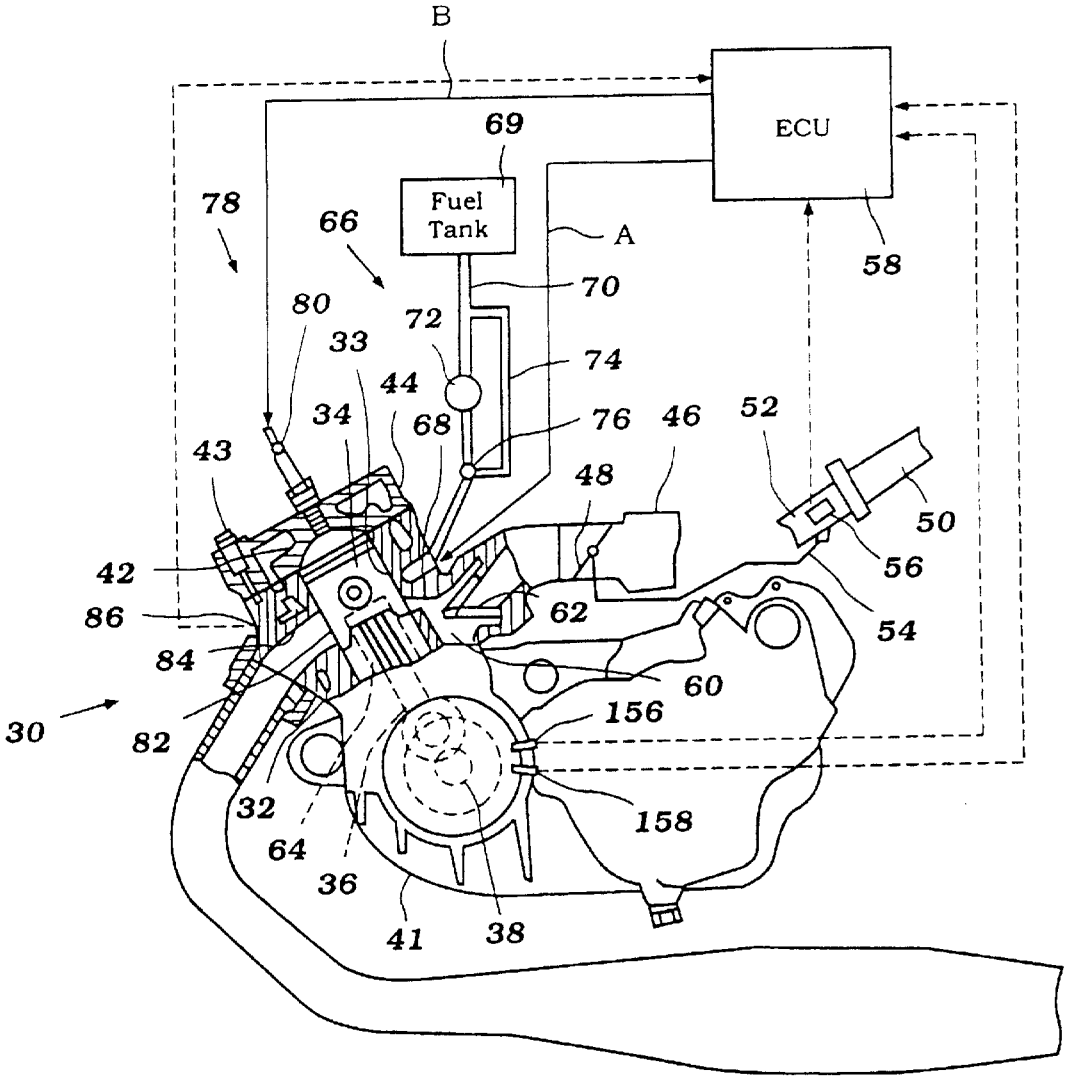
FIG. 1 is a partially schematic cross-sectional view taken through a two-cycle internal combustion engine having a fuel injection system in accordance with the present invention.

Referring to FIG. 1, an engine 30 is shown as only having only a single cylinder, and in partial schematic cross-section, with certain auxiliary components also shown partially schematically and/or in cross-section. It will be readily apparent to those skilled in the air however, how the invention may be utilized in conjunction with engines having other cylinder numbers and other cylinder configurations.

The engine 30 illustrated is depicted as arranged to operate on a two-cycle principle. Again, however, the invention may be utilized with other types of engines operating on other operation principles such as four-cycle or be of the rotary type.

The engine 30 is comprised of a cylinder block 32, which forms at least one cylinder bore 33 in which a piston 34 reciprocates. The piston 34 is connected to a first end of a connecting rod 36, the second end of which is connected to a crankshaft 38. The crankshaft 38 is rotatably journalled in a crankcase chamber formed by the cylinder block 32 and a crankcase member 41, which is detachably affixed thereto. In the embodiment illustrated, the crankcase member or cover 41 is formed integrally with a transmission cover.

The area of the cylinder bore 33 above the head of the piston 34 forms a combustion chamber, indicated generally by the reference numeral 42. This combustion chamber is formed by the cylinder bore 33, the head of the piston 34 and a recess formed in a cylinder head 44 which is affixed to the cylinder block 32 with bolts 43 or in other known manners and which closes the upper end of the cylinder bore 33. The cylinder head 44 may, if desired, be formed integrally with the cylinder block 32 as is well known in this art.

Air is provided to each combustion chamber 42 through a suitable induction system. This system includes an intake passage 46 having a throttle valve 48 movably positioned therein for controlling the flow rate of air therethrough. The throttle valve 48 is preferably remotely actuated. For example, when the engine 30 is used to power a personal watercraft, a throttle grip 50 may be positioned on a steering handle 52. The grip 50 actuates a throttle control cable 54 connected to the throttle valve 48. Preferably, a throttle position sensor 56 is associated with the grip for providing throttle position data to an electronic control unit (ECU) 58 associated with the engine.

Air which flows past the throttle valve 48 selectively flows through an intake port 60 into the crankcase as controlled by a reed valve 62. This valve 62 is arranged to permit the flow of air through the port 60 in the direction of the crankcase but not in the opposite direction towards the intake passage 46.

The air in the crankcase is compressed by the downward movement of the piston 34 and eventually flows through one or more scavenge passages 64 to the combustion chamber 42. As known to those of skill in the art, when the engine 30 has multiple combustion chambers and pistons, the crankcase is divided into a plurality of individual chambers, one corresponding to each combustion chamber.

As the piston 34 moves upwardly, a fresh charge of air is supplied to the crankcase through the reed valve 62.

A fuel injection system, indicated generally by the reference numeral 66, is provided for delivering fuel under high pressure to the combustion chamber 42. This fuel supply system 66 includes a fuel injection device 68 which is mounted in the cylinder head 44 and which supplies the fuel in a manner, which will be described later by reference to FIG. 2.

Although the invention is described in conjunction with direct cylinder injection, fuel may be introduced into the crankcase or into the intake or scavenge passages, as known to those of skill in the art.

The fuel system 66 includes a fuel supply such as a fuel tank 69 in which fuel is contained. Fuel is pumped from the tank 69 through a conduit 70 or line with a low pressure fuel pump 72 that is driven in any known manner. The fuel pump 72 delivers fuel to the fuel injection device 68, which is described in more detail below. Of course, a variety of other fuel supplies for supplying fuel to the injection device 68 may be utilized other than that just described.

Fuel, which is supplied to the injection device 68 but not supplied to the engine 30 thereby, is preferably returned to the fuel tank 69 through a return line, indicated by the reference numeral 74. In that regard, a pressure-regulating valve 76 is positioned along the main fuel supply line 70 and permits fuel to flow back to the tank 69 when the pressure exceeds a predetermined pressure.

The engine 30 includes an ignition system 78, which includes a spark plug 80, which is mounted in the cylinder head 44. The spark plug 80 is selectively fired for initiating ignition of the fuel air charge formed by the air inducted through the scavenge passage(s) 64 and the fuel supplied by the fuel injection device 68.

The burnt charge caused by the firing of the spark plug 80 is discharged through one or more exhausts passages 82 formed in the cylinder head 44 to the atmosphere through a suitable exhaust system. An exhaust timing control valve (not shown) may be provided for controlling the timing of the flow of exhaust from the combustion chamber 42 to the exhaust passage 82.

A sampling chamber 84 is provided off of the combustion chamber 42 in communication with the exhaust passage 82 some distance downstream of the combustion chamber 42. Exhaust gasses flow into this chamber 84 where they are sampled by an oxygen sensor 86 which provided air/fuel ratio data to the ECU 58 for use in controlling the fuel flow delivery rate to the engine. The chamber 84 is preferably arranged with a valve (not shown), which permits the flow of exhaust gas from the combustion chamber 42 to the sampling chamber 84 but not in the direction from the sampling chamber 84 to the combustion chamber 42.

The injection device 68 will now be described primarily with reference to FIG. 2. The injection device 68 includes a pumping element 90 as described in more detail below. The injection device 68 includes a housing assembly that is comprised of a main housing part 92 that defines an interior pumping chamber 94. Fuel is delivered from the low pressure pump 72 to this chamber 94 through the conduit 70 that is attached thereto by a fitting 96.

Fuel selectively flows through a fuel inlet 98 of a check valve 100 positioned in the fitting 96. This check valve 100 preferably includes a ball 102, which is biased by a spring 104 into a flow occluding position. When the fuel pressure is large enough, the ball 102 moves against the spring force, permitting fuel to flow through the inlet 98 and through a port 108 in the housing 92 into the chamber 94.

The pumping chamber 94 is closed at one end by a cover piece 110 that mounts the pumping device 90. Although described in more detail below, the pumping device 90 includes a pressure surface 112 positioned in the chamber 94 at the end closed by the cover piece 100.

The housing 92 of the injection device 68 defines a discharge port 114 at the end thereof opposite the pumping device 90. An injector valve 116 controls the flow of fuel through the port 114. This valve 116 includes an injector body 118 having a head 120, which normally closes the injector port 114 and is held in its closed position by a coil compression spring 122 or other biasing means.

In the embodiment illustrated, the spring 122 is mounted between a shoulder of the housing 92 and a mounting plate 124. When the pressure of the fuel generated by the high pressure pumping device or element 90 is sufficient, the injector valve 116 is forced open and the fuel is discharged at high pressure through the injector port 114.

Figure 3:
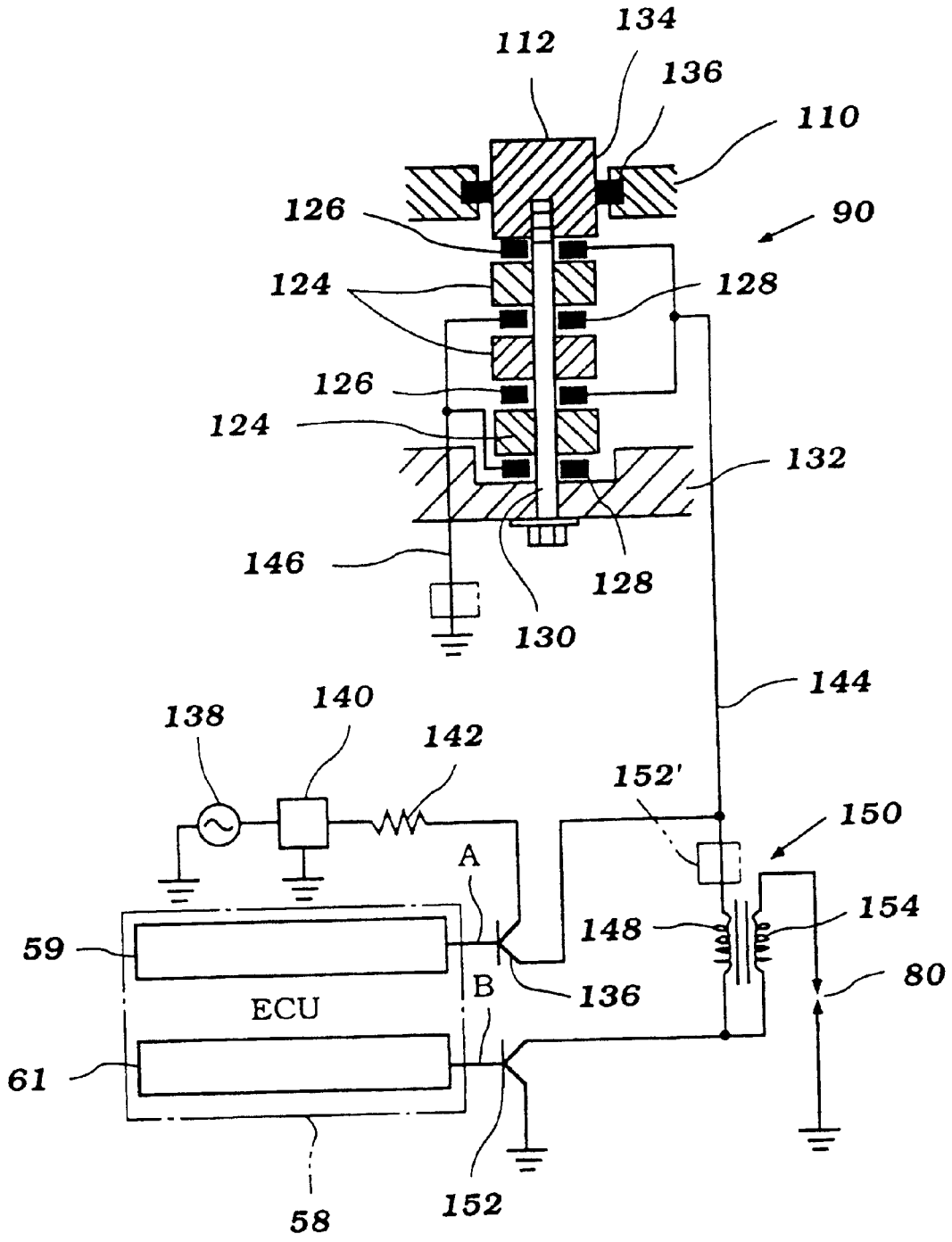
FIG. 3 illustrates in cross-section a pumping element of the fuel injection device illustrated in FIG. 2 and illustrates a control circuit associated therewith.

The pumping device 90 will be described in detail with reference made primarily to FIG. 3. In the preferred arrangement, the pumping device 90 is an electrostrictive device. Preferably, the electrostrictive device comprises three piezoelectric boards or elements 124 disposed between alternating positive and negative electrodes 126,128. These elements 124,126,128 are mounted on a clamping bolt 130.

Figure 2:
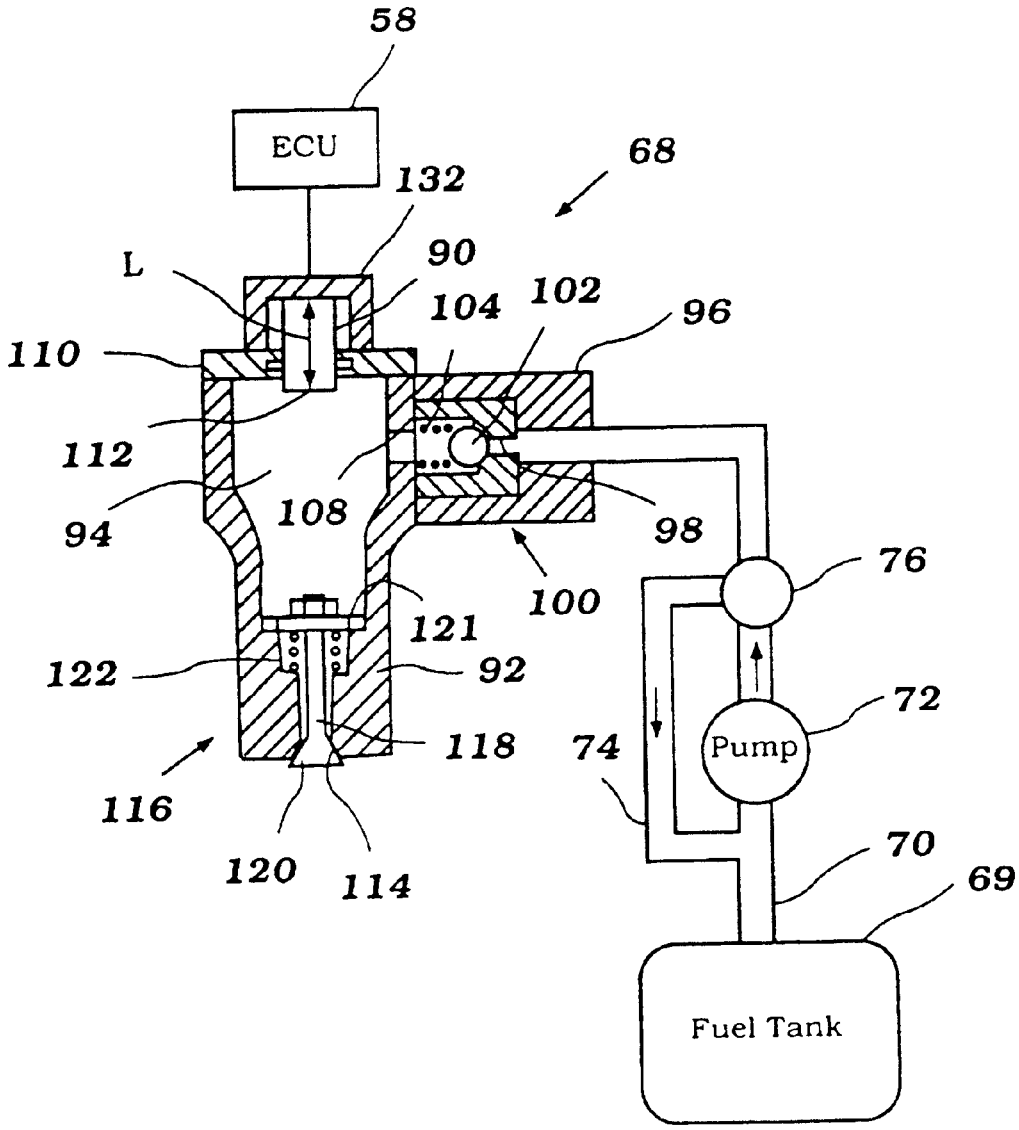
FIG. 2 illustrates in cross-section a fuel injection device of the injection system of the present invention and illustrates schematically a portion of a fuel supply system associated therewith.

A first end of the bolt 130 is connected to a mount 132, which is supported by the cover 110 (see FIG. 2). A plunger 134 is connected to the opposite end of the bolt 130. The plunger 134 extends through an opening in the cover 110, having its pressure surface 112 positioned in the chamber 94. Preferably, the area of the pressure surface 112 is greater than the area of the valve port 114 when the valve is opened. A seal 136 is proved between the cover 110 and plunger 134 for sealing the opening.

The piezoelectric elements 124 are arranged to expand against the elastic force of the bolt 130 upon application of a suitable electric current. Upon expansion, the plunger 134 moves into the chamber 94. As described in more detail below, this expansion causes a pressure wave to propagate through the fuel in the chamber 94 in the direction of the valve 116, opening it and permitting fuel under high pressure to flow through the port 114 of the injection device 68 into the combustion chamber 42.

Means are provided for controlling the energizing of the piezoelectric elements. Each positive electrode 126 is in communication with an energizing circuit, which is controlled by the ECU 58. The ECU 58 includes a fuel injection control 59, which selectively activates a switch 136 that is supplied with electrical current from a generator or AC power source 138 through an AC to DC converter 140 and resistor 142. When the switch 136 is activated, power flows from the power source 138 through a supply line 144 to each positive electrode 126.

Each negative electrode 128 is connected to ground through a ground lead 146.

Coupled to the energizing circuit is one end of a primary coil 148 of an ignition coil 150 associated with the ignition system 78. The other end of this primary coil 148 is connected to ground through a second switch 152. This switch 152 is controlled by an ignition timing control 61 of the ECU 58. A secondary coil 154 of the ignition coil 150 is associated with the primary coil 148 for providing a boosted voltage to the spark plug 80, as known to those of skill in the art.

In the embodiment illustrated, the ECU 58 receives air/fuel ratio data from the oxygen sensor 86, throttle position data from the throttle position sensor 56, and referring to FIG. 1, engine speed data from a crankshaft sensor 156 and crank angle data from a crank angle sensor 158 associated with the crankshaft 38. Based on this information, the ECU 58 provides an output signal "A" for regulating the fuel injection element 68, and an output signal "B" for regulating the ignition system.

Figure 4:
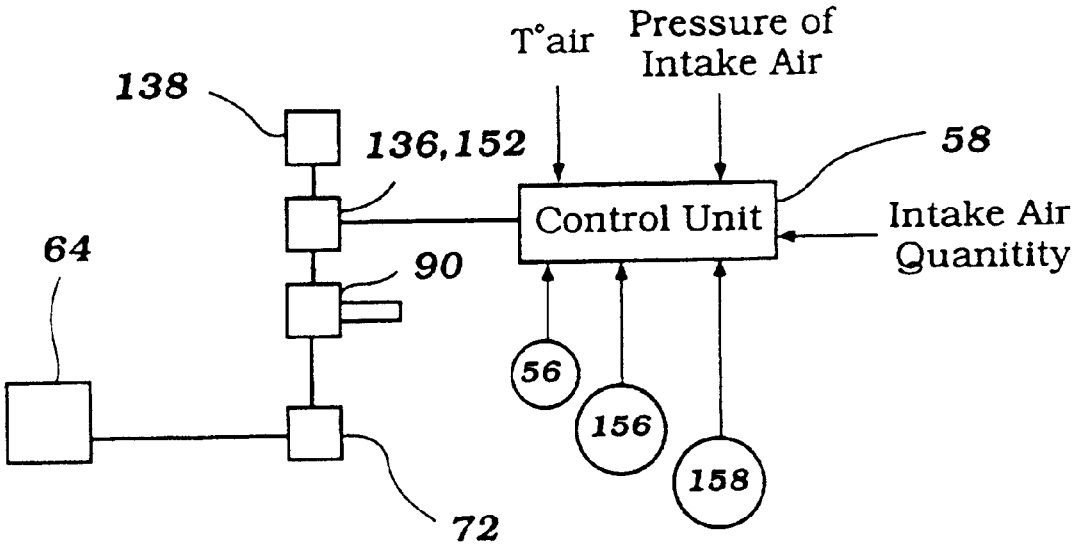
FIG. 4 schematically illustrates the fuel injection device of the invention.

A modified diagram of this control arrangement is illustrated in FIG. 4. In this illustration, the ECU 58 is also provided air temperature and pressure data, as well as intake volume or quantity data.

The effect of the system is as follows. Fuel is provided by the fuel system 66 to the chamber 94 of the injection device 68 through the check valve 100. At an appropriate time, the ECU 58 provides a signal "A" activating the switch 136 and providing a voltage to the positive electrodes 126. This voltage causes the piezoelectric elements 124 to expand, forcing the pressure surface 112 of the plunger 134 inwardly against the fuel in the chamber 94. This creates a shock or pressure wave in the fuel, which moves therethrough to the valve 116. The pressure wave opens the valve 116, and fuel flows through the port 114 into the combustion chamber 42.

In accordance with the present invention, the injection system is arranged so that the fuel injection quantity and timing may be varied with accuracy. In the above-described arrangement, the fuel injection quantity may be varied by changing the magnitude of the pressure or shock wave generated by the expansion of the electrostrictive element in the direction L (see FIG. 2). As described in more detail below, the magnitude of this wave may be changed in a variety of manners, thereby controlling the fuel injection quantity.

After completion of the fuel injection sequence, the ECU 58 switches on the second switch 152, permitting power to flow through the ignition coil 150 and triggering the firing of the ignition or spark plug 80.

Upon completion of the discharge, the switch 136 is shut off, permitting the electrostrictive element to return to its original or unexpanded position. This movement creates a lowered pressure in the chamber 94, which permits fuel to flow through the fuel inlet 108 into the chamber 94, refilling it.

It is noted that if the returning speed of the element is very high, a negative pressure is produced near the pressure surface 112 of the plunger 134 and fuel flows toward the plunger 134. A resulting reflected pressure wave may again cause the valve 116 to open, further lowering the fuel pressure in the chamber 94 furthering the flow of fuel into the chamber through the inlet 108.

It is noted that while the second switch 152 is preferably positioned on the groundside of the ignition coil 150, such may be positioned between the primary coil 148 and the power source (in position 152' in FIG. 3) if the opposite ends of the coil portions 148,154 are grounded.

In accordance with the present invention, the ECU 58 controls the energy supply to the injection device 68, and more particularly the pumping device 90, such that at least one of (1) time to energize; (2) the peak voltage or power value; (3) the frequency of energization; or (4) the rate of increase of electric energy from the energy supply is increased for larger (or decreased for smaller) engine operating load, whereby the magnitude, time and/or frequency of the pressure wave, and thus the fuel injection amount, is varied.

Figure 5:
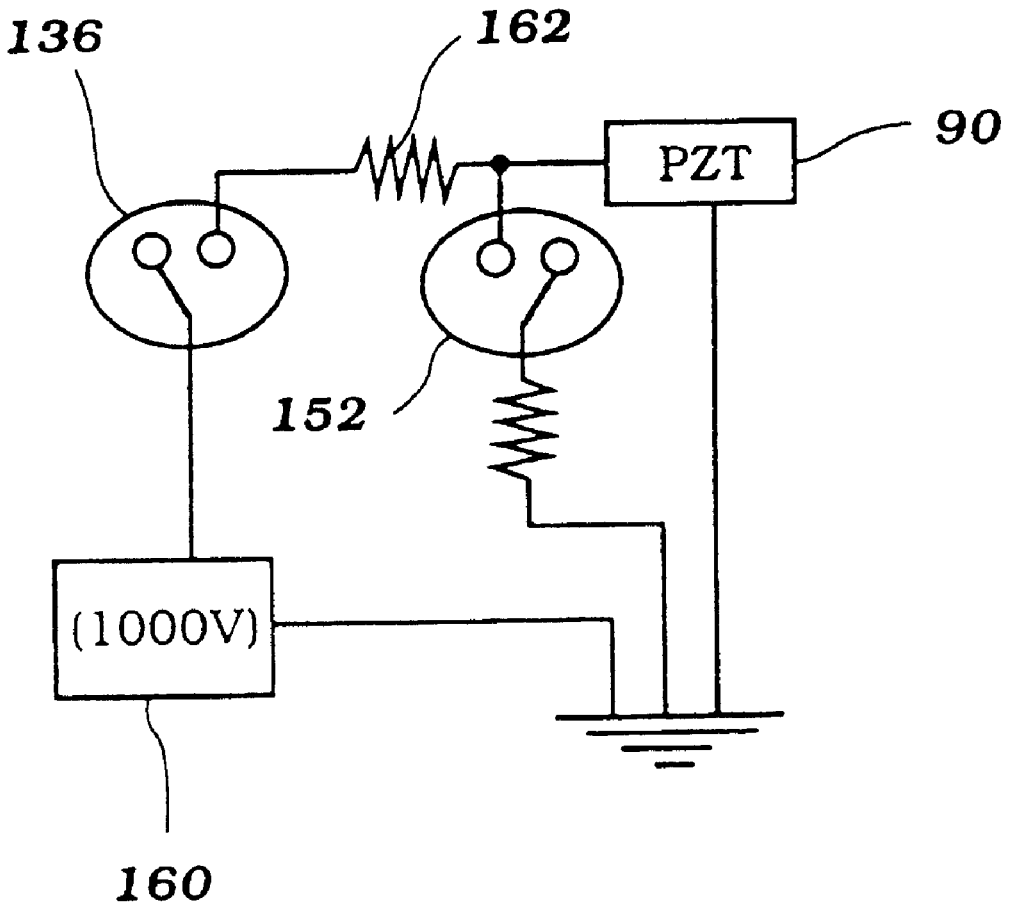
FIG. 5 is a simplified drive circuit diagram for the fuel injection device of the invention.
Figure 6A:
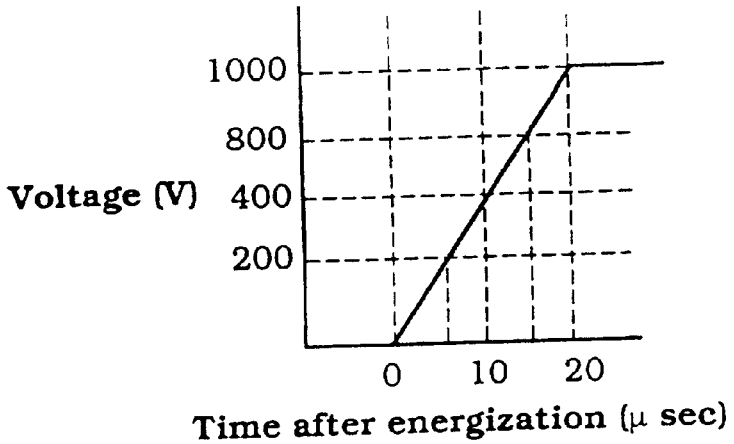
FIG. 6(*a*) is a graph illustrating the characteristic of voltage vs. time for the fuel injection device of the invention.
Figure 6B:
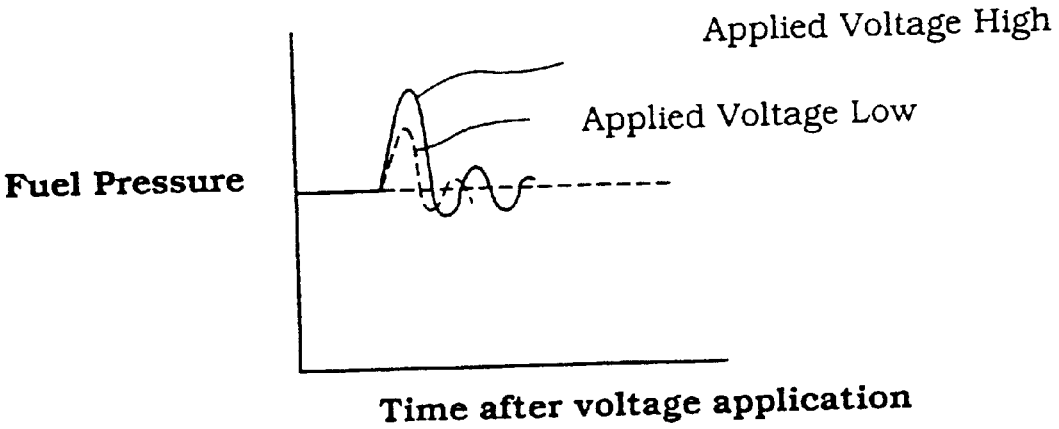
Figure 7:
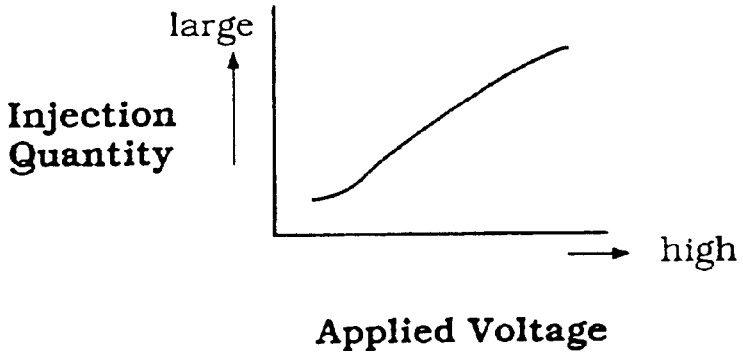
FIG. 7 is a graph illustrating the characteristic of fuel injection quantity vs. applied voltage for the fuel injection device of the invention.

In a first arrangement control arrangement will be described herein with reference primarily to FIGS. 5–7. In this embodiment, the energization circuit is schematically illustrated as comprising a power source 160 (such 1000V DC) connected through a resistor 162 to the piezoelectric pumping device 90, which is generally electrically equivalent to a capacitor of capacitance F.

Upon switching the switch 136, power is provided from the power source 160 through the resistor 162 to the pumping element 90. As best illustrated in FIG. 6(*a*), this energization voltage increases over time until it is generally equal to the power source voltage.

The energization of the pumping element 90 causes a shock or pressure wave, as described above, with a larger shock wave results from an increased application voltage to the piezoelectric elements 124 of the device 90. As illustrated in FIG. 6(*b*), the increased application voltage thus translates into an increased fuel pressure. Thus, and referring to FIG. 7, application of a larger voltage to the device 90 causes an increase in fuel pressure, and thus fuel injection volume as compared to a smaller applied voltage. This is true since a reduced voltage corresponds to a reduced fuel pressure, with this reduced pressure capable of opening the valve 116 a shorter time than for a large fuel pressure.

Thus, in accordance with a first aspect of the invention, the fuel injection quantity may be controlled by controlling the peak or maximum application voltage to the device 90.

Referring now to FIGS. 8–11, a specific manner for controlling the application voltage is illustrated. In general, the time required for the voltage of the electrostrictive element of the device 90 to reach a predetermined voltage application value is proportional to the resistance of the resistor 162 and the capacitance F of the electrostrictive element.

Figure 8:
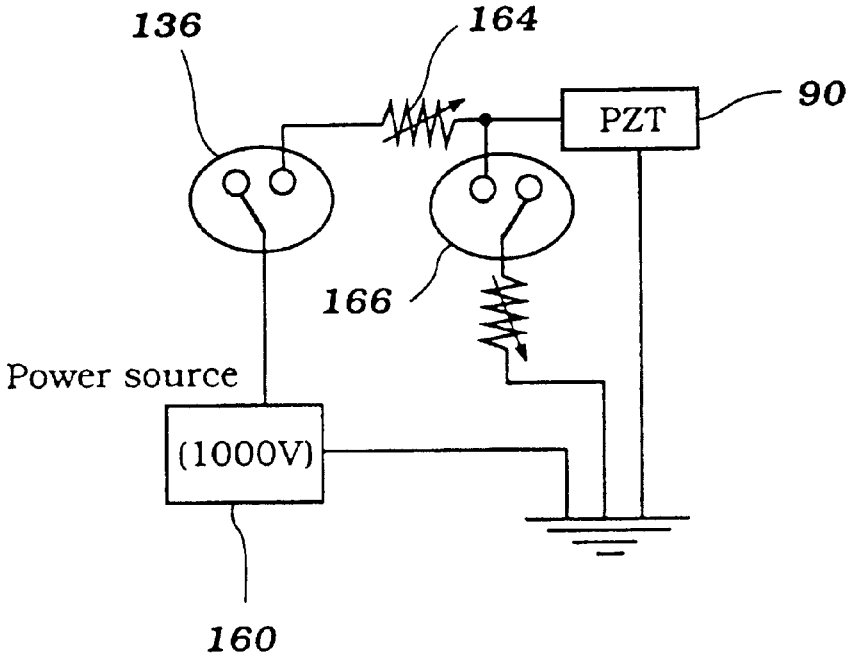
FIG. 8 is a simplified second drive circuit diagram for the fuel injection device of the invention.

Therefore, as illustrated in FIG. 8, use of a variable resistor 164 permits control over the speed at which the applied voltage rises.

Figure 9:
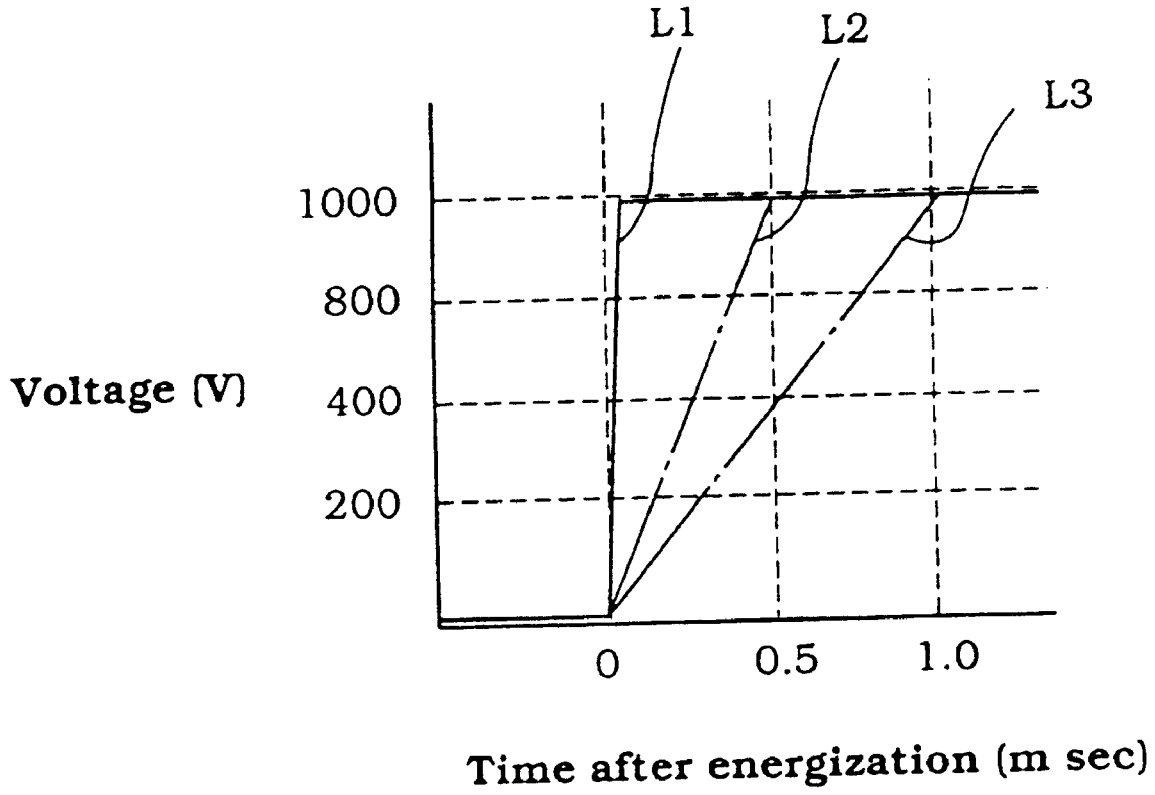
FIG. 9 is a graph illustrating voltage vs. time after energization for the fuel injection device of the invention for varying sized resistors.

Referring to FIG. 9, lines L1, L2 and L3 represent the characteristic curves of voltage vs. time for a three different resistor values for the resistor 164, with the smallest resistance value corresponding to line L1, and the largest by line L3.

Figure 10:
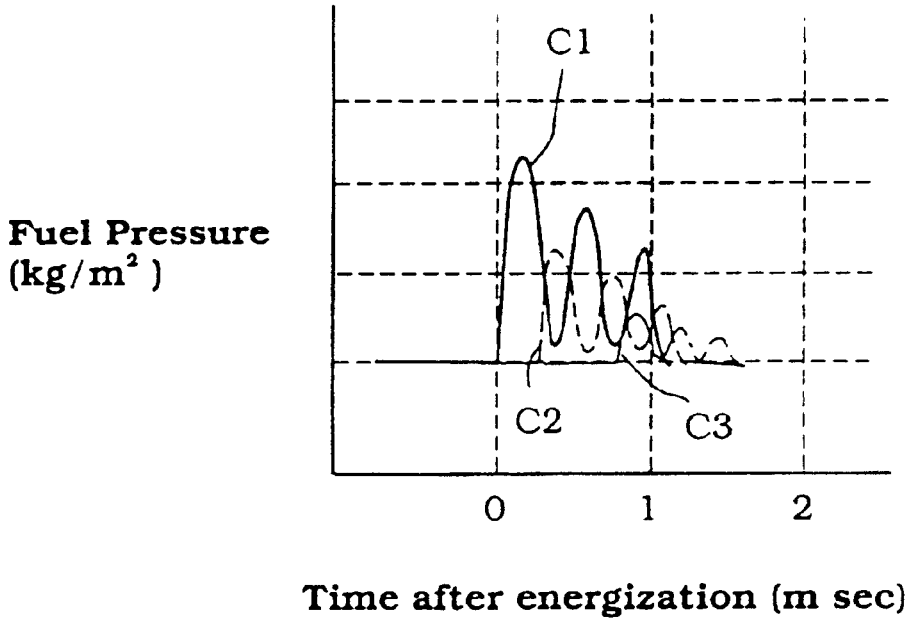
FIG. 10 is a graph illustrating fuel pressure vs. time after energization for the fuel injection device of the invention at various energization levels.

When the value of the resistor 164 is changed, the speed at which the voltage rises is controlled, as is the peak value of a shock or pressure wave generated by the electrostrictive element of the pumping device 90. FIG. 10 illustrates this effect, where for a low resistance value and voltage increase at rate L1, curve C1 represents the peak fuel pressure vs. time. For larger resistance values and a slower voltage speed increase, the peak value is reduced, as indicated by curves C2 and C3 (in this figure curves C2 and C3 are offset in starting time so as to be more readily readable in the graph).

Figure 11:
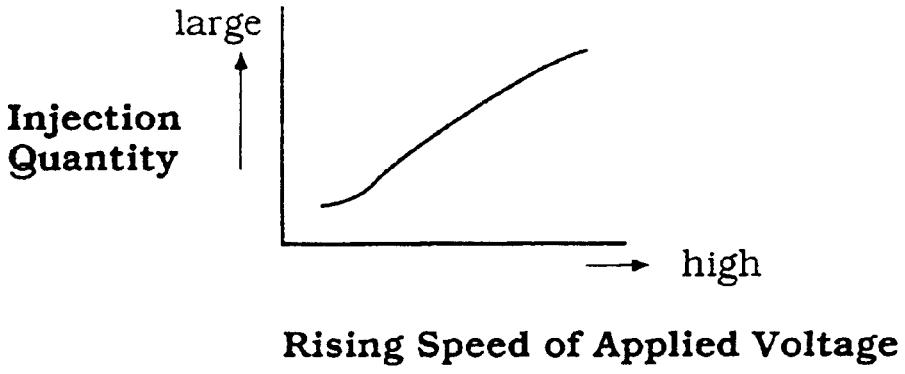
FIG. 11 is a graph illustrating fuel injection quantity vs. change in speed of applied voltage for the fuel injection device of the invention.

As illustrated in FIG. 11, the fuel injection quantity delivered by the injection device 68 may thus be controlled by changing the speed at which the voltage to the electrostrictive element of the pumping device 90 is increased. In particular, as the speed at which the voltage rises increases, the quantity of fuel injected rises as well. As stated above, this rate of increase may be controlled by changing the resistance between the power source and the pumping device 90.

Figure 12:
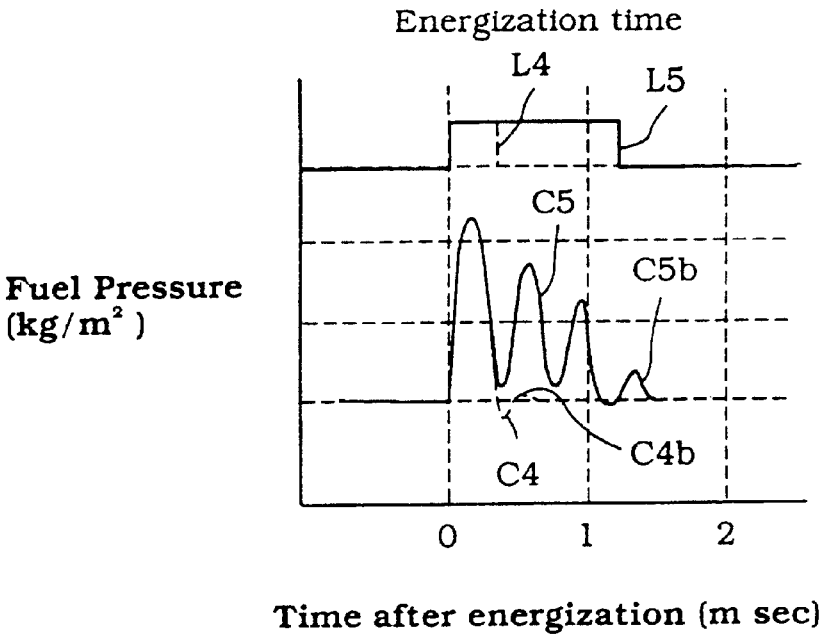
FIG. 12 is a graph illustrating fuel pressure vs. time after energization for the fuel injection device of the invention for differing energization time lengths.

An alternate arrangement for controlling the quantity of fuel delivered by the pumping device 90 will be described with reference to FIGS. 12 and 13. Referring to FIG. 12, it may be seen that when the time duration of energization of the electrostrictive element of the pumping device 90 is increased from time L4 to a longer time L5, the shock or pressure wave produced by the plunger 134 reverberates and the surges in the pressure chamber 94, and the peak shock wave is increased from once (in characteristic curve C4 when the time is a short L4) to three times (as illustrated by curve C5).

Figure 13:
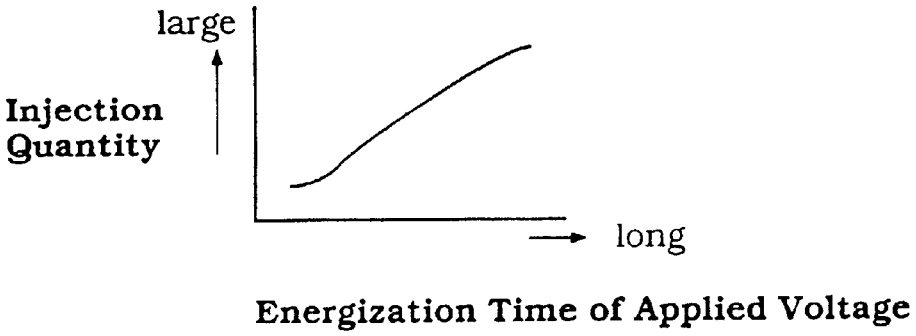
FIG. 13 is a graph illustrating the fuel injection quantity vs. time of applied voltage for the fuel injection device of the invention.

As a result, and as illustrated in FIG. 13, because multiple shock waves having sufficient pressure to open the valve 116 are generated in a cycle, more fuel is delivered. Thus, it may be appreciated that injection quantity increases as energization time increases.

Referring again to FIG. 12, curves C4b and C5b illustrate a shock wave resulting from a rapid discharging of the electrostrictive element of the pumping device 90. The rapid discharging causes, as described above, fuel to flow into a low pressure area near the plunger 134 and reflect off of the plunger creating a reflected wave which if large enough will open the valve 116 and permit fuel to be delivered. In general, the rate of discharge is controlled by the resistance value R (164 in FIG. 8) between the power source and electrostrictive element. When the resistance value is small, the rate of discharge is high, and a large discharge shock wave is generated. On the other hand, when the resistance value is high or large, the rate of discharge is low and the resultant shock wave may be insufficient to open the valve 116. Thus, the fuel quantity delivered may be controlled in part by selection of the appropriate discharge speed, such as by changing the resistance value.

Yet another arrangement for controlling the quantity of fuel delivered with the pumping device 90 of the present invention will be described with reference to FIGS. 1416. In accordance with this arrangement, the frequency of energization (i.e. operation frequency) per cycle to the electrostrictive element of the pumping device 90 is controlled. Referring to FIG. 8, this operation frequency refers to the frequency with which the energization switch 136 is turned on and then off and the discharge switch 166 is turned on an then off (with a single "frequency" being counted as the turning on and off of each switch, it being understood that the switches may be turned on and off simultaneously).

Figure 14:
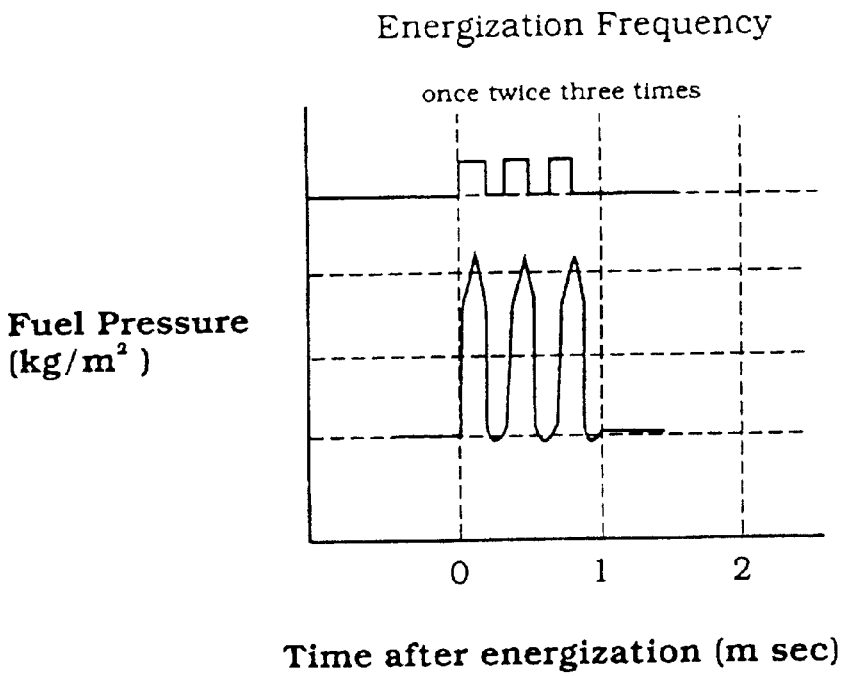
FIG. 14 is a graph illustrating fuel pressure vs. time after energization upon a repeating frequency of energization for the fuel injection device of the invention.
Figure 15:
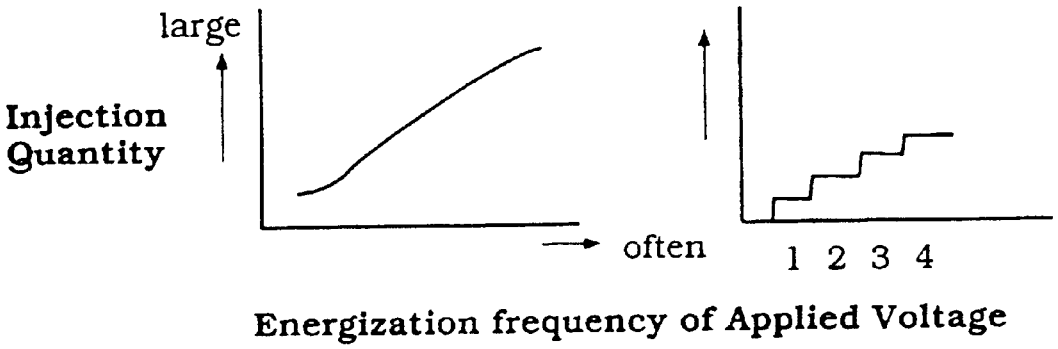
FIG. 15 is a graph illustrating injection quantity vs. energization frequency of applied voltage for the fuel injection device of the invention.

FIG. 14 illustrates the characteristic of fuel pressure over time at each operation frequency. As illustrated in FIG. 15, as the operation frequency per cycle increases, the injection quantity increases. This is true since per given cycle, each operation frequency causes the delivery of an amount of fuel, with each additional operation frequency per cycle resulting in an added amount of fuel being delivered in that cycle.

Figure 16:
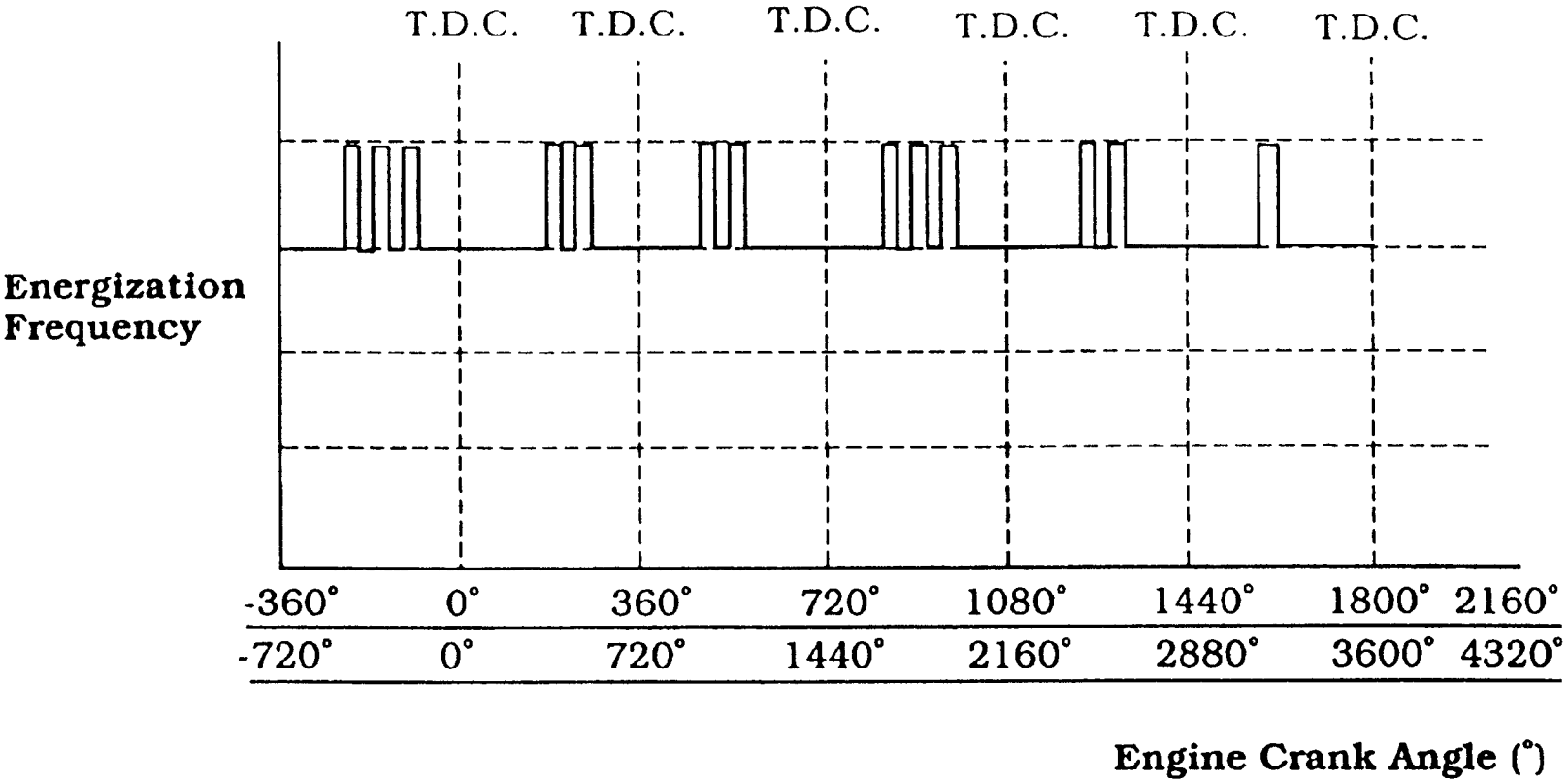
FIG. 16 is a diagram illustrating injection timing for the fuel injection device of the invention at various engine crank angles.

Referring to FIG. 16, this operation frequency may be changed dependent upon engine crank angle, whereby the fuel injection timing and quantity may be accurately controlled.

In all of the embodiments previously described, the force necessary to achieve the pressure pulsation has been accomplished through the use of an electrostrictive device, and more particularly a stack of piezoelectric elements. Those of skill in the art will appreciate that a single piezoelectric element may be utilized, but that use of a multiple number of similar elements permits generation of a larger pressure wave.

In addition, a magnetostrictive element may be used in place of the electrostrictive element as the driving force of the pumping device 90. In that instance, the magnetostrictive element is placed between the plunger 134 and mount 132 within a coil or similar element for generating a varying magnetic field. When energy is applied to this coil and a field is generated, the element expands, driving the plunger outward.

In use of a magnetostrictive element, the fuel injection quantity and fuel injection timing can be controlled accurately by controlling the magnitude of the magnetic field applied to the element and/or the rate of increase or decrease of the field, as well as the energization frequency, in like manner to that described above. However, in this arrangement, the discharge switch 166 and resistor 162,164 may be eliminated.

Figure 17:
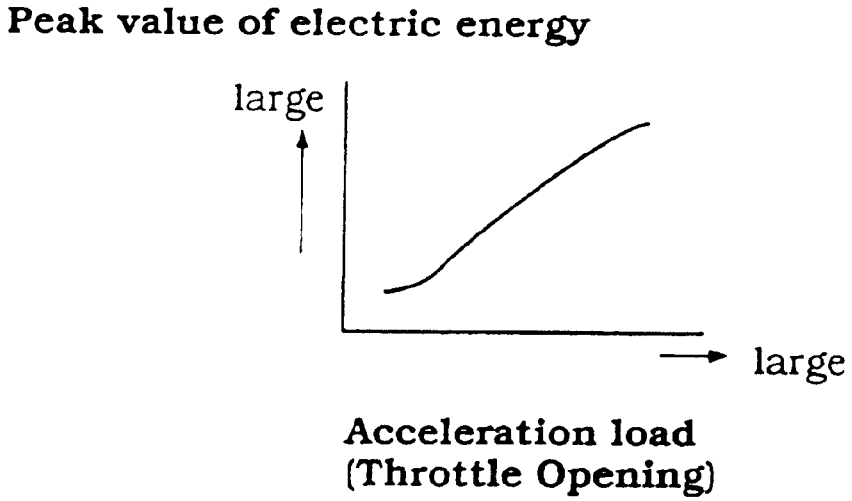
FIG. 17 is a graph illustrating peak value of electric energy supplied to the fuel injection device vs. engine acceleration load.
Figure 18:
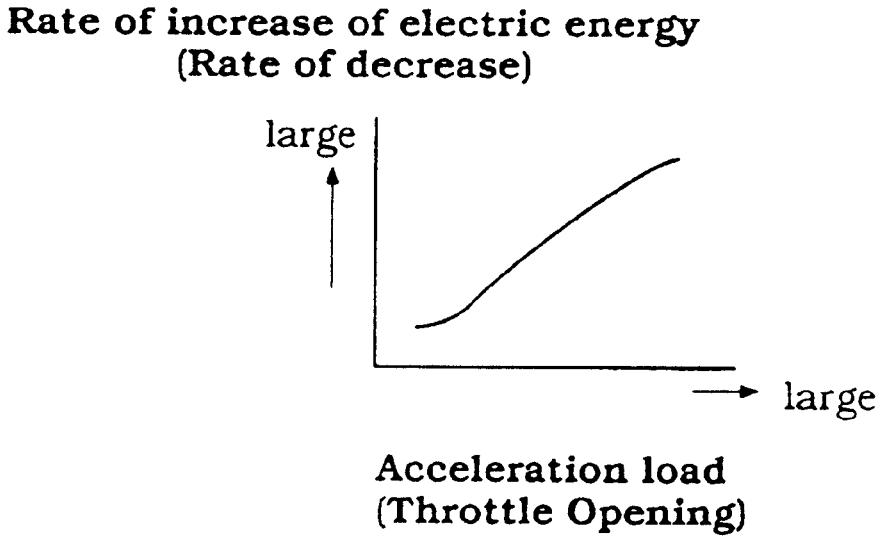
FIG. 18 is a graph illustrating rate of increase in electrical energy supplied to the fuel injection device vs. acceleration load.
Figure 19:
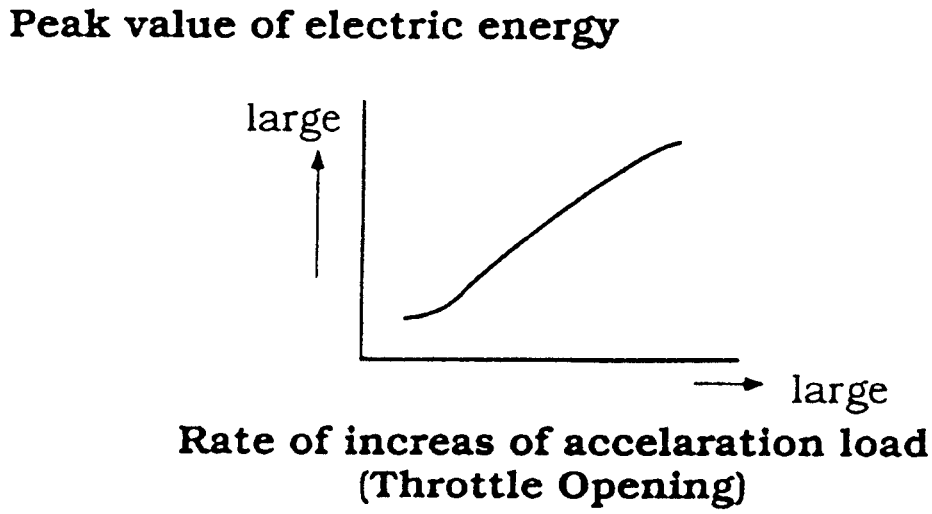
FIG. 19 is a graph illustrating peak value of electric energy supplied to the fuel injection device vs. rate of increase in acceleration load.
Figure 20:
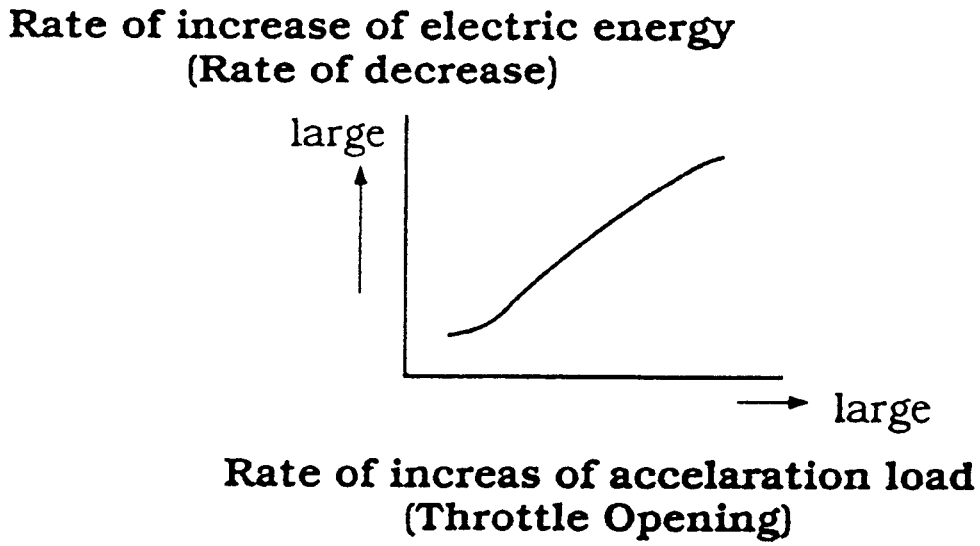
FIG. 20 is a graph illustrating rate of increase in electrical energy supplied to the fuel injection device vs. rate of increase in acceleration load.

Referring now to FIGS. 17–20, the method of controlling the fuel injection device 68 to control fuel quantity delivered and timing thereof in relation to an operating engine is illustrated. As illustrated in FIGS. 17 and 19, the peak value of electric energy supplied to the pumping device 90 is increased as acceleration or load increases or as the rate of acceleration or load increases (i.e. large throttle opening angle or increasing throttle opening angle). As illustrated in FIGS. 18 and 20, one or both of the rate of voltage increase or decrease are increased as acceleration or load increases or as the rate of acceleration or load increases (i.e. large throttle opening angle).

Of course, those skilled in the art will readily understand that the foregoing description is that of preferred embodiments of the invention. In the embodiment of FIGS. 1–7 the pumping device has been referred to as either "electrostrictive' or "piezoelectric" while the embodiment of FIGS. 8–11 and 12 and 13 refer to it as only "electrostrictive". The alternative embodiment described in the last two paragraphs on page 12 describe is as "magnetostrictive". Thus the term "piezoelectric" is used in the claims to cover all such materials. In addition various changes and modifications may be made without departing from the spirit and scope of the invention, as defined by the appended claims.

What is claimed is:

1. A fuel injection device for a fuel system of an engine for delivering fuel to a fuel injector valve of said engine, said injection device including an electrostrictive element driven fluid pumping device comprising a pumping chamber, a piezoelectric element disposed within said pumping chamber and forming the sole means within said pumping chamber for increasing the pressure therein, said pumping chamber having a continuously open outlet through which pressurized fluid is discharged to said fuel injector valve, said piezoelectric element being selectively energized by a voltage supplied by an electric circuit which is switchable between a powered condition and a discharged condition, wherein the total volume of fuel injected in a single injection cycle through said outlet is controlled by changing a peak voltage or the rate of increase or decrease in voltage applied to said piezoelectric element by said circuit.

2. The fuel injection device in accordance with claim 1, wherein said volume of fuel injected in a single injection cycle is large when a load upon said engine is large, as compared to when the load upon said engine is small.

3. The fuel injection device in accordance with claim 1, wherein said volume of fuel injected in a single injection cycle is increased as a load on said engine increases.

4. The fuel injection device in accordance with claim 1, wherein said volume of fuel injected in a single injection cycle is decreased as a load on said engine decreases.

* * * * *